US008091518B2

(12) United States Patent
Shikida et al.

(10) Patent No.: US 8,091,518 B2
(45) Date of Patent: Jan. 10, 2012

(54) COOLING PASSAGE PARTITION FOR AN INTERNAL COMBUSTION ENGINE

(75) Inventors: Takasuke Shikida, Okazaki (JP); Shuichi Hanai, Toyota (JP); Makoto Hatano, Obu (JP); Toshihiko Kumasaka, Tokyo (JP); Motonori Kondo, Tokyo (JP)

(73) Assignees: Toyota Jidosha Kabushiki Kaisha, Toyota-shi (JP); Aisan Kogyo Kabushiki Kaisha, Obu-shi (JP); Nichias Corporation, Minato-ku (JP)

( * ) Notice: Subject to any disclaimer, the term of this patent is extended or adjusted under 35 U.S.C. 154(b) by 527 days.

(21) Appl. No.: 12/309,609

(22) PCT Filed: Jul. 27, 2007

(86) PCT No.: PCT/JP2007/065210
§ 371 (c)(1),
(2), (4) Date: Mar. 10, 2009

(87) PCT Pub. No.: WO2008/016127
PCT Pub. Date: Feb. 7, 2008

(65) Prior Publication Data

US 2009/0194046 A1 Aug. 6, 2009

(30) Foreign Application Priority Data

Jul. 31, 2006 (JP) ..... 2006-207439

(51) Int. Cl.
*F02F 1/14* (2006.01)
*B21K 3/00* (2006.01)

(52) U.S. Cl. ..... 123/41.74; 123/41.79; 29/888.01

(58) Field of Classification Search ..... 123/41.72, 123/41.74, 41.79; 29/888.01
See application file for complete search history.

(56) References Cited

U.S. PATENT DOCUMENTS

2002/0000210 A1 1/2002 Shinpo et al.
(Continued)

FOREIGN PATENT DOCUMENTS

DE 101 02 644 C1 2/2001
(Continued)

OTHER PUBLICATIONS

Matsutani et al.; "Water Jacket Spacer for Improvement of Cylinder Bore Temperature Distribution," *SAE Technical Paper Series*; 2005 SAE World Congress; Detroit, Michigan; Apr. 11-14, 2005.

(Continued)

*Primary Examiner* — Noah Kamen
(74) *Attorney, Agent, or Firm* — Oliff & Berridge, PLC

(57) ABSTRACT

A partition member used in a cylinder block of an internal combustion engine is disclosed. The partition member is arranged in a groove-like cooling passage through which a cooling heat medium flows. The partition member includes a separating wall and a flexible lip member. The separating wall divides the cooling passage into an inner passage and an outer passage. The inner passage is located close to the cylinder bores, and the outer passage is located outside of the inner passage. The lip member extends from the separating wall toward the opening of the cooling passage in such a manner that, when the partition member is arranged in the cooling passage, the lip member contacts one of the inner surfaces of the cylinder block forming the cooling passage. When the partition member is arranged in the cooling passage, the distal edge portion of the flexible lip member contacts the inner surface due to force produced through flexible shape restoration of the lip member.

9 Claims, 14 Drawing Sheets

U.S. PATENT DOCUMENTS

| | | | |
|---|---|---|---|
| 2005/0056238 | A1 | 3/2005 | Marinica et al. |
| 2010/0242868 | A1 | 9/2010 | Shikida et al. |

FOREIGN PATENT DOCUMENTS

| | | | |
|---|---|---|---|
| EP | 1 167 735 | A2 | 1/2002 |
| JP | U-6-12039 | | 2/1994 |
| JP | A-11-223186 | | 8/1999 |
| JP | A-2000-345838 | | 12/2000 |
| JP | A-2002-13440 | | 1/2002 |
| JP | A-2004-19475 | | 1/2004 |
| JP | A-2006-90197 | | 4/2006 |
| JP | A-2006-207459 | | 8/2006 |
| JP | A-2007-309221 | | 11/2007 |
| JP | A2008-25474 | | 2/2008 |

OTHER PUBLICATIONS

Japanese Office Action issued in Japanese Application No. 2006-207439 on Feb. 15, 2011 (with translation).

Oct. 11, 2011 Notice of Allowance issued in Japanese Patent Application No. 2006-207439 (with translation).

2
4
4a
4b
4d
4e
6
6a
6b
6c
8

COOLING PASSAGE PARTITION FOR AN INTERNAL COMBUSTION ENGINE

FIELD OF THE INVENTION

The present invention relates to a partition member that is provided in a cooling passage defined in a cylinder block of an internal combustion engine and divides the cooling passage into a plurality of passages, a cooling mechanism using the partition member, and a method for forming the cooling mechanism.

BACKGROUND OF THE INVENTION

It is generally known that the temperature in an upper portion of a bore forming body (a bore wall) that defines cylinder bores in a cylinder block becomes higher than the temperature in a lower portion of the bore forming wall. Such non-uniform heat distribution in the bore wall may increase fuel consumption or deteriorate emission. To ensure uniform heat distribution in the bore forming wall, Japanese Laid-Open Patent Publication No. 2002-13440 describes a technique in which a spacer formed of, for example, resin is arranged in a bottom portion of a water jacket (a groove-like cooling passage) of a cylinder block. The technique thus adjusts the flow resistance of the coolant flowing in the water jacket and uniformly cools a bore wall.

However, since the spacer is fitted in the bottom portion of the water jacket, coolant is allowed to flow only in a path located upward from the spacer after the flow resistance of the coolant has been adjusted. It is thus difficult to perform highly accurate temperature adjustment in the cylinder block, or, particularly, in a cylinder bore forming body.

Also, since the spacer is formed of resin with relatively high rigidity, great load must be applied to the spacer when the spacer is inserted into the water jacket and arranged in the bottom portion of the water jacket. This makes it difficult to manufacture a cooling mechanism of an internal combustion engine.

SUMMARY OF THE INVENTION

Accordingly, it is an objective of the present invention to provide an easy-to-manufacture cooling mechanism for an internal combustion engine that facilitates highly accurate temperature adjustment in a cylinder bore forming body.

In order to achieve the foregoing objective and in accordance with a first aspect of the present invention, a partition member provided in a cylinder block of an internal combustion engine is provided. The engine has a groove-like cooling passage through which a cooling heat medium flows. The partition member is arranged in the groove-like cooling passage. The cooling passage extends to encompass cylinder bores of the cylinder block, and has a bottom surface, a pair of opposing inner surfaces, and an opening located opposite to the bottom surface. The partition member includes a separating wall and a flexible lip member. The separating wall divides the cooling passage into an inner passage and an outer passage. The inner passage is located close to the cylinder bores, and the outer passage is located outside of the inner passage. The separating wall has a lower end portion facing the bottom surface of the cooling passage and an upper end portion located opposite to the lower end portion. When the partition member is arranged in the cooling passage, the height from the bottom surface of the cooling passage to the upper end portion of the separating wall is less than the depth of the cooling passage. The flexible lip member extends from the separating wall toward the opening in such a manner that, when the partition member is arranged in the cooling passage, the lip member contacts one of the inner surfaces at an intermediate position in a direction along the depth of the cooling passage. The lip member has a distal edge portion that extends beyond the one inner surface before the partition member is arranged in the cooling passage. When the partition member is arranged in the cooling passage, the distal edge portion contacts the one inner surface due to force produced through flexible shape restoration of the lip member.

In accordance with a second aspect of the present invention, a cooling mechanism of an internal combustion engine is provided. The cooling mechanism includes a groove-like cooling passage, which is provided in a cylinder block of an internal combustion engine and allows flow of a cooling heat medium to flow therethrough, and a partition member provided in the cooling passage. The cooling passage extends to encompass cylinder bores of the cylinder block. The cooling passage has a bottom surface, a pair of opposing inner surfaces, and an opening located opposite to the bottom surface. The partition member includes a separating wall and a flexible lip member. The separating wall divides the cooling passage into an inner passage and an outer passage. The inner passage is located close to the cylinder bores, and the outer passage is located outside of the inner passage. The separating wall has a lower end portion facing the bottom surface of the cooling passage and an upper end portion located opposite to the lower end portion. A contact portion that contacts the bottom surface of the cooling passage is provided on the lower end portion. When the partition member is arranged in the cooling passage, the height from the bottom surface of the cooling passage to the upper end portion of the separating wall is less than the depth of the cooling passage. The lip member extends from the upper end portion of the separating wall toward the opening in such a manner that, when the partition member is arranged in the cooling passage, the lip member contacts the inner surface closer to the cylinder bores at an intermediate position in a direction along the depth of the cooling passage. The lip member has a distal edge portion that extends beyond the inner surface closer to the cylinder bores before the partition member is arranged in the cooling passage. When the partition member is arranged in the cooling passage, the distal edge portion contacts the inner surface closer to the cylinder bores due to force produced through flexible shape restoration of the lip member. The cylinder block has a first supply port for supplying cooling heat medium to the cooling passage. The first supply port is opened to the inner passage.

In accordance with a third aspect of the present invention, a method for forming a cooling mechanism of an internal combustion engine is provided. The method for forming the cooling mechanism includes: providing a groove-like cooling passage through which a cooling heat medium flows in a cylinder block of the engine, wherein the cooling passage extends to encompass cylinder bores of the cylinder block, and wherein the cooling passage has a bottom surface, a pair of opposing inner surfaces, and an opening located opposite to the bottom surface; preparing a partition member that is arranged in the cooling passage, the partition member having a separating wall and a flexible lip member, wherein the separating wall divides the cooling passage into an inner passage and an outer passage, the inner passage being located close to the cylinder bores, the outer passage being located outside of the inner passage, wherein the separating wall has a lower end portion facing the bottom surface of the cooling passage and an upper end portion located opposite to the lower end portion, wherein a contact portion that contacts the bottom surface of the cooling passage is provided on the lower end portion, and wherein, when the partition member is arranged in the cooling passage, the height from the bottom surface of the cooling passage to the upper end portion of the separating wall is less than the depth of the cooling passage, wherein the lip member extends from the upper end portion of the separating wall toward the opening in such a manner that, when the partition member is arranged in the cooling passage, the lip member contacts the inner surface closer to the cylinder bores at an intermediate position in a direction along the depth of the cooling passage, wherein the lip member has a distal edge portion that extends beyond the inner surface closer to the cylinder bores before the partition member is arranged in the cooling passage; and inserting the partition member through the opening of the cooling passage until the contact portion contacts the bottom surface of the cooling passage, wherein, when the partition member is arranged in the cooling passage, the distal edge portion contacts the inner surface closer to the cylinder bores due to force produced through flexible shape restoration of the lip member.

DESCRIPTION OF THE PREFERRED EMBODIMENTS

A first embodiment of the present invention will now be described.

Figure 3:
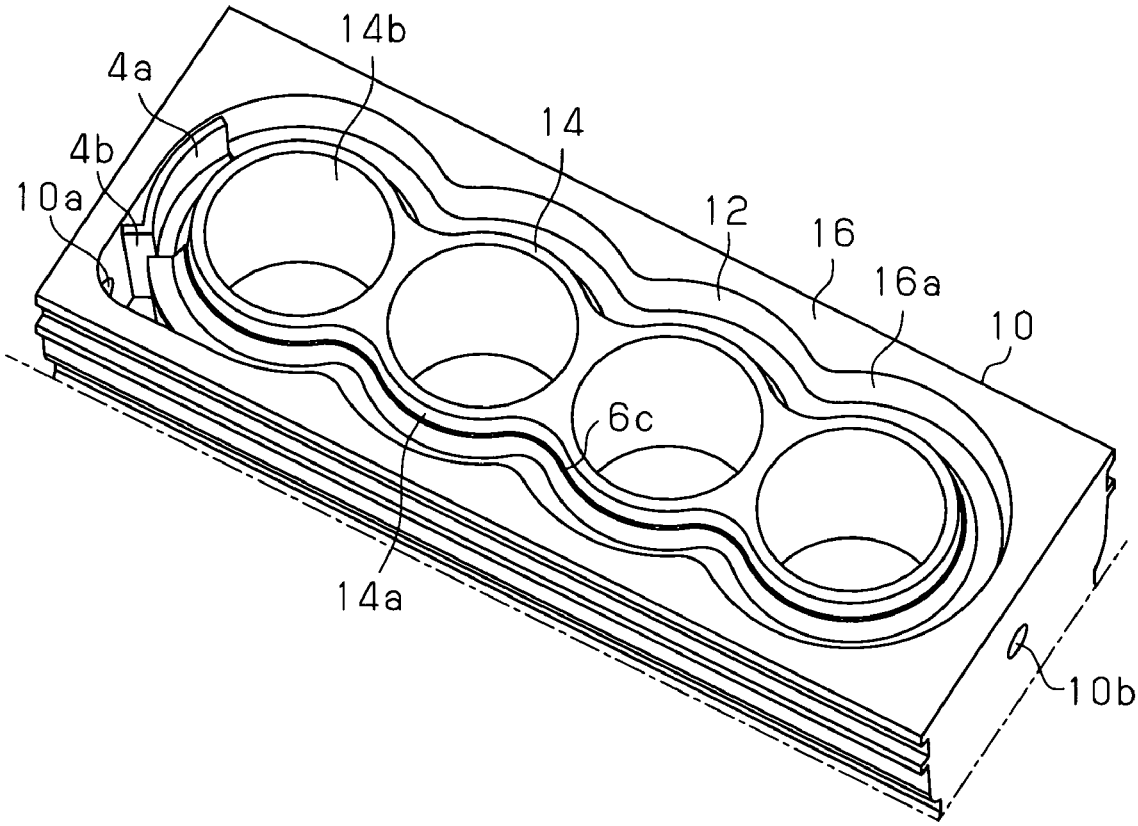
FIG. 3 is a perspective view showing a cylinder block having the partition member shown in FIGS. 1A to 1F provided in a water jacket.

A partition member 2 shown in FIGS. 1A to 1F is provided in a water jacket (a groove-like cooling passage in which cooling heat medium flows) 12, which is arranged in a cylinder block 10 of an engine shown in FIG. 3. Referring to FIG. 3, the cylinder block 10 is an open-deck type cylinder block having four cylinder bores 14*b* that are aligned along a line. The cylinder block 10 also has a cylinder bore forming body (a cylinder wall) 14, which defines the cylinder bores 14*b*. Among the four cylinder bores 14*b*, the cylinder bore 14*b* located leftmost in FIG. 3 is defined as a first cylinder bore #1. The cylinder bore 14*b* adjacent rightward from the first cylinder bore #1 is defined as a second cylinder bore #2. The cylinder bore 14*b* adjacent rightward from the second cylinder bore #2 is defined as a third cylinder bore #3. The cylinder bore 14*b* adjacent rightward from the third cylinder bore #3, or located rightmost, is defined as a fourth cylinder bore #4.

Figures 1A, 1B, 1C, 1D, 1E, 1F:
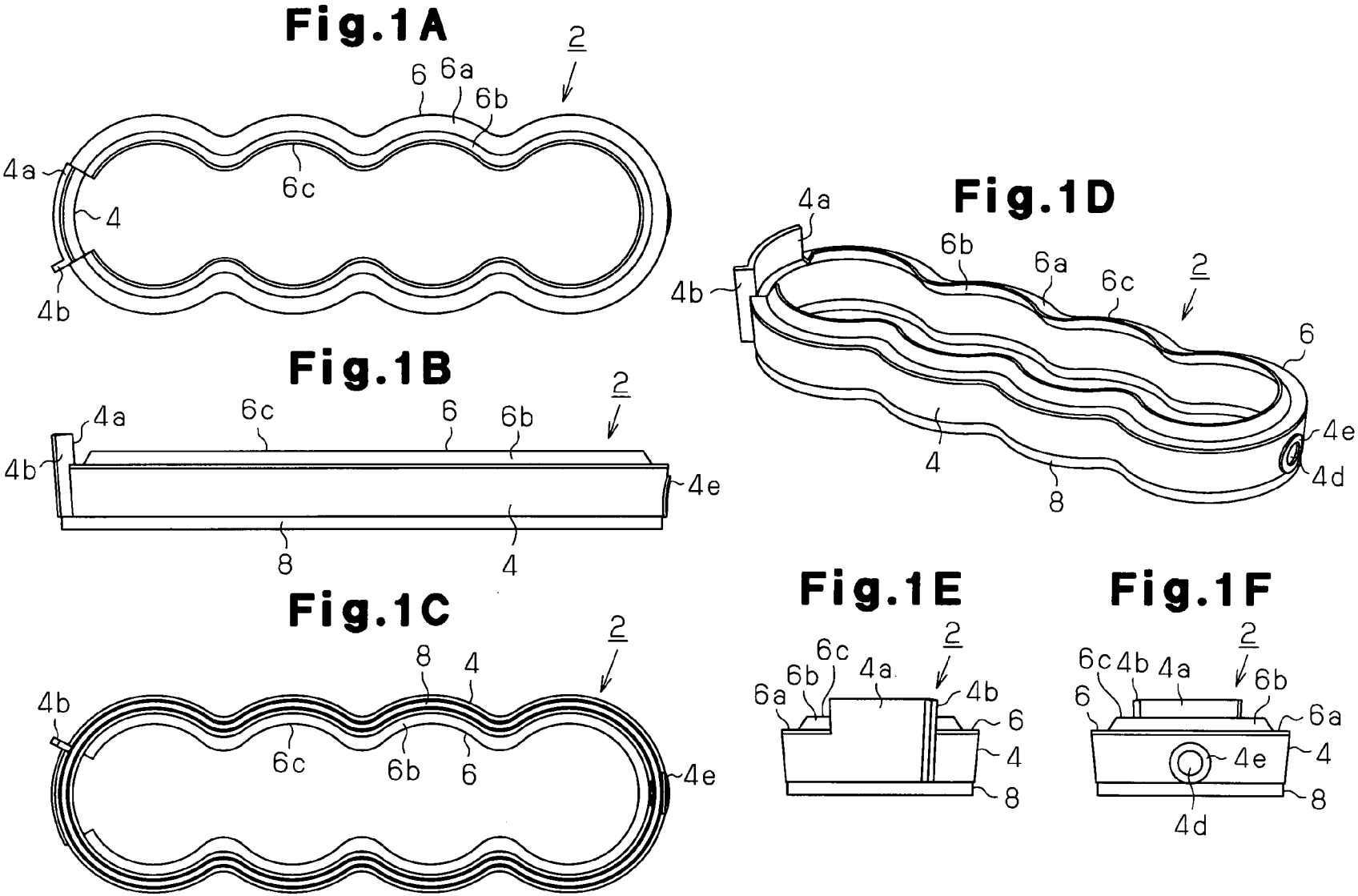
FIG. 1A is a plan view showing a partition member according to a first embodiment of the present invention.
FIG. 1B is a front view showing the partition member shown in FIG. 1A.
FIG. 1C is a bottom view showing the partition member shown in FIG. 1A.
FIG. 1D is a perspective view showing the partition member shown in FIG. 1A.
FIG. 1E is a left side view showing the partition member shown in FIG. 1A.
FIG. 1F is a right side view showing the partition member shown in FIG. 1A.
Figure 2:
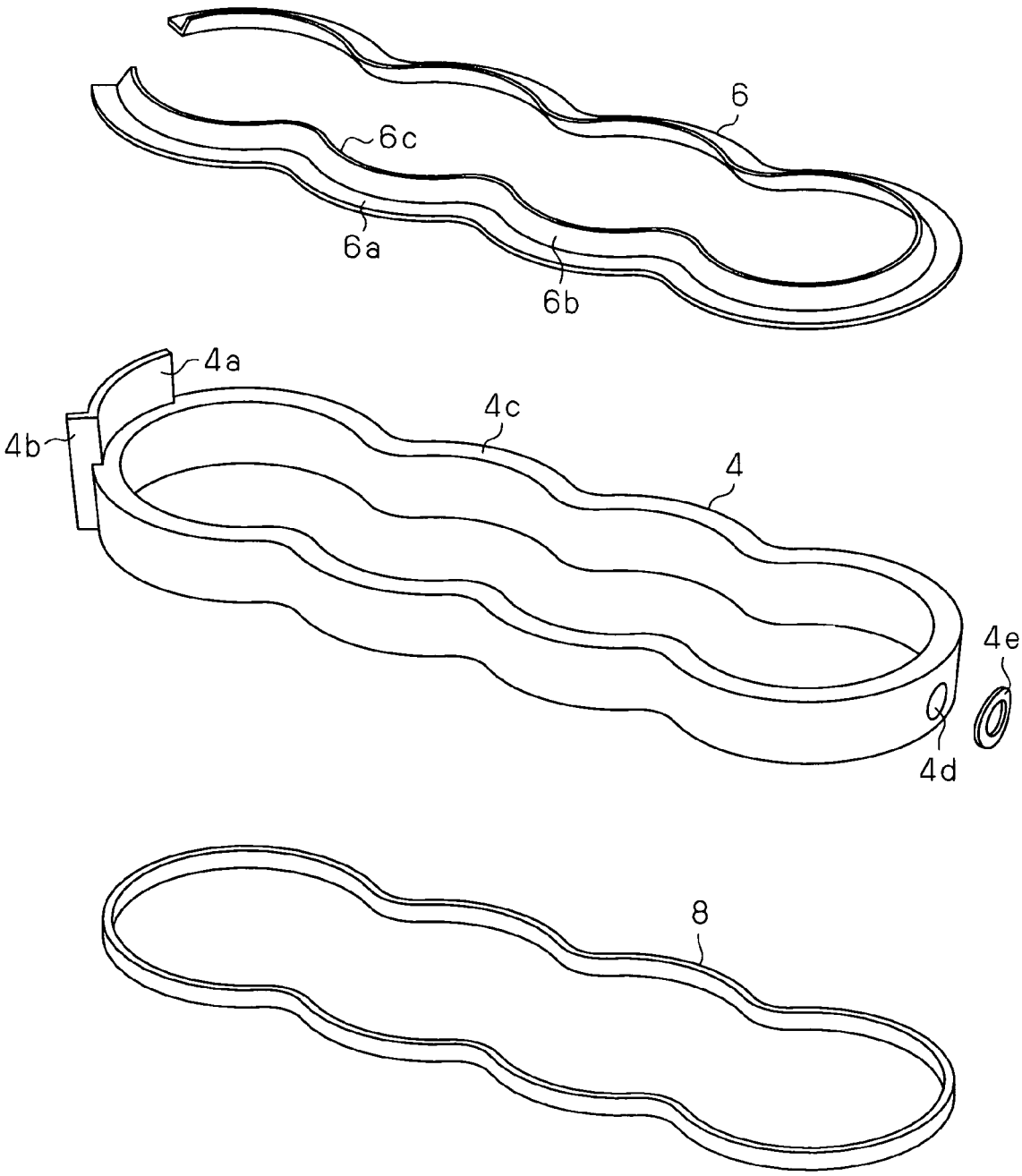
FIG. 2 is an exploded perspective view showing the partition member shown in FIGS. 1A to 1F.

As shown in FIG. 2, the partition member 2 has a base member 4, a flexible lip member 6, and a flexible contact member 8. The base member 4 is shaped in correspondence with an outer circumferential surface 14*a* (inner surface) of the cylinder bore forming body 14. The base member 4 maintains the shape of the partition member 2 as a whole and is formed of a material having higher rigidity than the material of the lip member 6. In the first embodiment, the base member 4 is formed of olefin-based resin.

As shown in FIG. 3, the base member 4 is arranged in a water jacket 12 of the cylinder block 10. In other words, referring to FIG. 4, the thickness of the base member 4 is smaller than the width of the water jacket 12. The width of the water jacket 12 refers to the distance between the outer circumferential surface 14*a* of the cylinder bore forming body 14 and an inner circumferential surface 16*a* (inner surface) of an outer circumferential wall 16 of the cylinder block 10.

Figure 4:
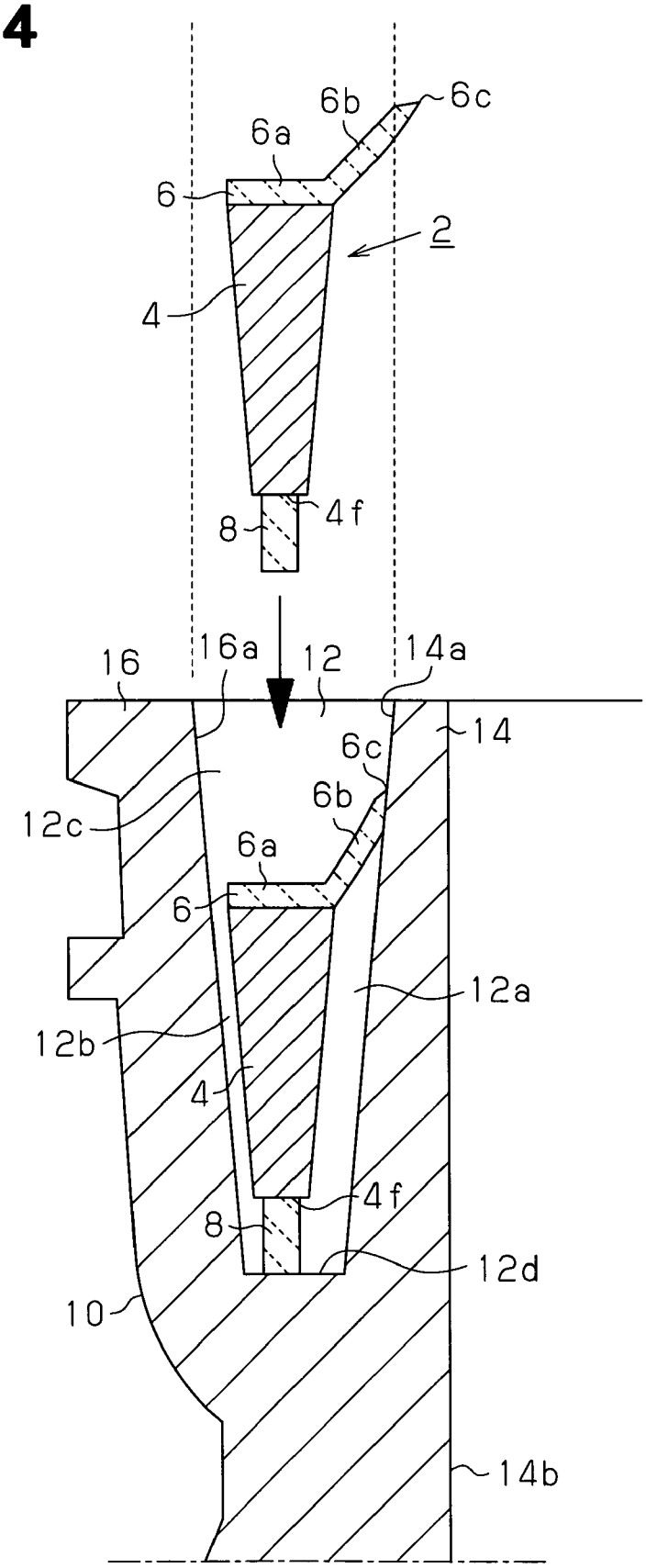
FIG. 4 is a longitudinal cross-sectional view showing the position of the partition member shown in FIGS. 1A to 1F in relation to the position of the water jacket.
Figure 5:
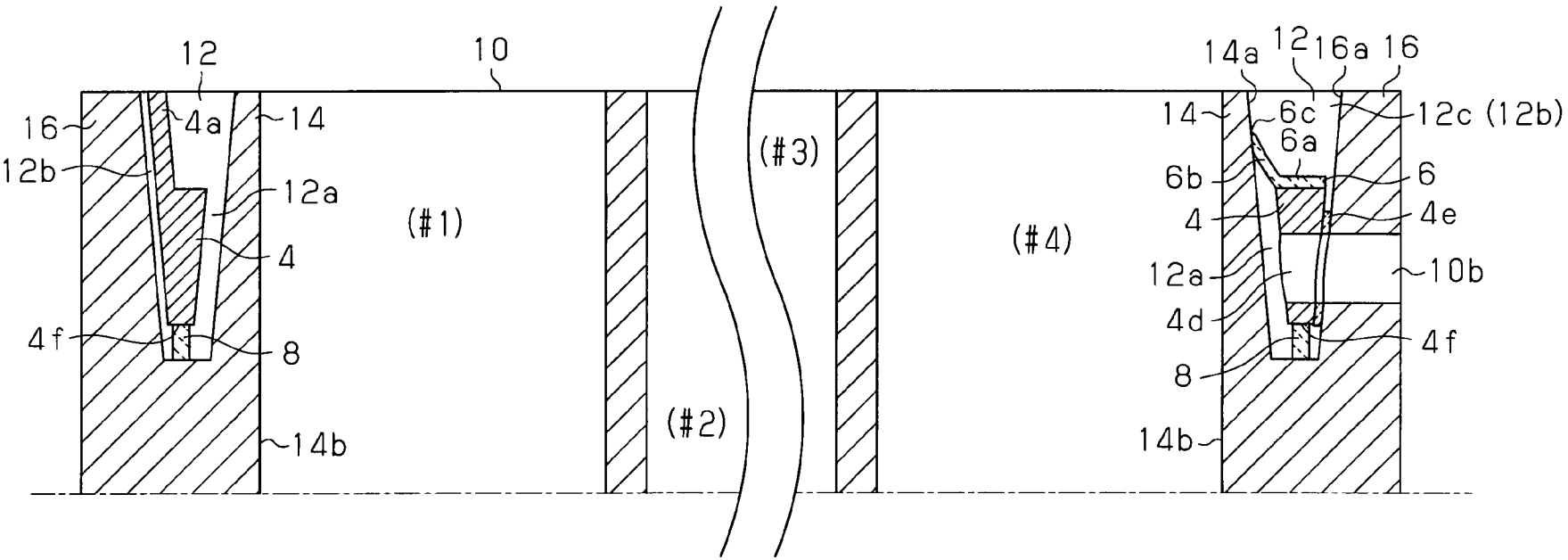
FIG. 5 is a longitudinal cross-sectional view along a direction in which bores are arranged in the cylinder block, illustrating the partition member of FIGS. 1A to 1F arranged in the water jacket.

As illustrated in FIGS. 4 and 5, the partition member 2 divides the interior of the water jacket 12 into an inner passage 12*a* and an outer passage 12*b*. The inner passage 12*a* is defined by the partition member 2 and the cylinder bore forming body 14. The outer passage 12*b* is defined by the partition member 2 and the outer circumferential wall 16.

With reference to FIGS. 1A to 1F, a guide wall 4*a* is formed in the base member 4 at a position corresponding to the first cylinder bore #1. Referring to FIG. 5, the height of the guide wall 4*a* is set in such a manner that the top surface of the guide wall 4*a* becomes flush with the top surface of the cylinder block 10 in which an opening of the water jacket 12 is defined. The guide wall 4*a* guides coolant (cooling heat medium) from the water jacket 12 to a water jacket (not shown) provided in a cylinder head.

A blocking wall 4*b* is formed integrally with the guide wall 4*a*. As shown in FIG. 3, a first opening 10*a* is defined in a portion of the outer circumferential wall 16 adjacent to the blocking wall 4*b*. The coolant is introduced into the water jacket 12 through the first opening 10*a*. The blocking wall 4*b* projects from the guide wall 4*a* toward the outer circumferential wall 16 to block the outer passage 12*b* at a position adjacent to the first opening 10*a*.

A top surface 4*c* of the upper end portion of the base member 4 other than the guide wall 4*a* and the blocking wall 4*b* has a uniform height and is located lower than the top surface of the cylinder block 10 in which the opening of the water jacket 12 is defined. The top surface 4*c* is located, for example, at a height equal to approximately two thirds of the depth of the water jacket 12 with respect to a bottom surface 12*d* of the water jacket 12. In other words, when the partition member 2 is arranged in the water jacket 12, the height from the bottom surface 12*d* of the water jacket 12 to the upper end portion (the top surface 4*c*) of the base member 4 is less than the depth of the water jacket 12. The lip member 6 is bonded with the top surface 4*c*.

A through hole 4*d* is defined in a portion of the base member 4 opposite to the guide wall 4*a*, or the portion of the base member 4 corresponding to the fourth cylinder bore #4, and extends horizontally through the base member 4. A seal ring 4*e*, which is formed by a rubber-like elastic body, is bonded with the outer circumferential surface of the base member 4 in such a manner that the seal ring 4*e* encompasses the through hole 4*d*. As shown in FIG. 5, with the partition member 2 received in the water jacket 12, the seal ring 4*e* is held in tight contact with the inner circumferential surface 16*a* of the outer circumferential wall 16. A second opening 10*b*, which receives heated water, is defined in the outer circumferential wall 16. The sealing effect of the seal ring 4*e* prevents the heater water from flowing into the outer passage 12*b* through the second opening 10*b* and introduces the heated water to the inner passage 12*a*.

The lip member 6 is formed of flexible material. The lip member 6 of the first embodiment is formed of olefin-based elastomer. With reference to FIG. 2, the lip member 6 has a shape corresponding to the top surface 4*c* of the base member 4. The lip member 6 has a base portion 6*a*, which is bonded with the top surface 4*c* of the base member 4, and a lip portion 6*b* inclined upwardly from the base portion 6*a*. The lip portion 6*b* is formed in such a manner that, when the partition member 2 is not received in the water jacket 12, the surface area of the portion of the lip portion 6*b* encompassed by a distal edge portion 6*c* becomes smaller than the surface area of the portion of the cylinder bore forming body 14 encompassed by the outer circumferential surface 14*a*. In other words, when the partition member 2 is not provided in the water jacket 12, the distal edge portion 6*c* extends beyond the outer circumferential surface 14*a* of the cylinder bore forming body 14. That is, when the partition member 2 is received in the water jacket 12, the lip portion 6*b* contacts the outer circumferential surface 14*a* at an intermediate position with respect to the direction along the depth of the water jacket 12. Since the lip portion 6*b* is formed of flexible material, the lip portion 6*b* easily flexes. Thus, with the partition member 2 received in the water jacket 12, the lip portion 6*b* is easily expanded by the outer circumferential surface 14*a* of the cylinder bore forming body 14. As a result, the lip portion 6*b* is prevented from receiving great resistance force from the outer circumferential surface 14*a* of the cylinder bore forming body 14.

When the partition member 2 is inserted into the water jacket 12, the partition member 2 as a whole is received in the water jacket 12 with the lip member 6 held in contact with the outer circumferential surface 14*a* of the cylinder bore forming body 14. In this manner, the partition member is forcibly guided to an optimal position in the water jacket 12.

After the partition member 2 is received in the water jacket 12, the force produced through flexible shape restoration of the lip portion 6*b* maintains the contact between the distal edge portion 6*c* of the lip portion 6*b* and the outer circumferential surface 14*a* of the cylinder bore forming body 14. Thus, the inner passage 12*a* and the outer passage 12*b* are maintained in a mutually separate state in the water jacket 12. Further, since the lip portion 6*b* extends inward and diagonally upward from the base portion 6*a*, the partition member 2 does not easily separate from the water jacket 12.

The distal edge portion 6*c* of the lip portion 6*b* contacts the outer circumferential surface 14*a* at an intermediate position with respect to the depth. Thus, referring to FIG. 4, an upper area 12*c* in the water jacket 12 is located in the outer passage 12*b*. That is, the outer passage 12*b* is defined by a wall corresponding to the entire portion of the inner circumferential surface 16*a* of the outer circumferential wall 16 and, in the upper area 12*c*, a wall corresponding to an upper portion of the outer circumferential surface 14*a* of the cylinder bore forming body 14.

As viewed from above, the contact member 8 is shaped identically with the base member 4. However, the thickness of the contact member 8 is smaller than the thickness of the base member 4. The contact member 8 and the lip member 6 are formed of the same material. This improves tight contact performance of the partition member 2 with respect to the bottom surface 12*d* of the water jacket 12. The combination of the contact member 8 and the base member 4 except for the guide wall 4*a* and the blocking wall 4*b* corresponds to a separating wall recited in claims.

The lip member 6 and the contact member 8 are bonded with the base member 4 using adhesive or through welding or mechanical engagement. Alternatively, referring to FIG. 6, the partition member 2 may be formed as an integral body through die rotary molding (coinjection molding).

A method for forming the partition member 2 will hereafter be explained.

Figure 6A:
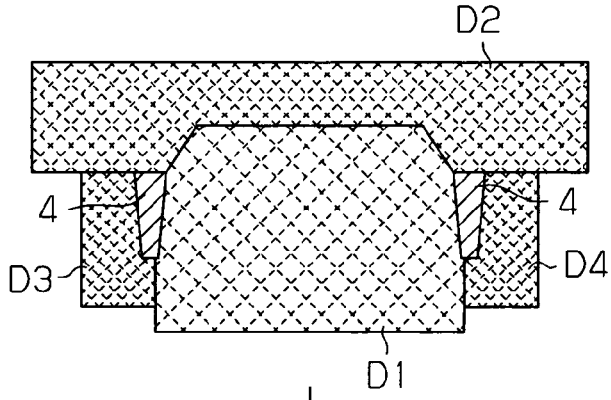
FIGS. 6A, 6B, 6C, and 6D are views representing a method of molding the partition member shown in FIGS. 1A to 1F.

As illustrated in FIG. 6A, in a first step, the base member 4 is provided through injection molding using a core die D1, a cavity die D2, and sliding dies D3, D4.

Figure 6B:
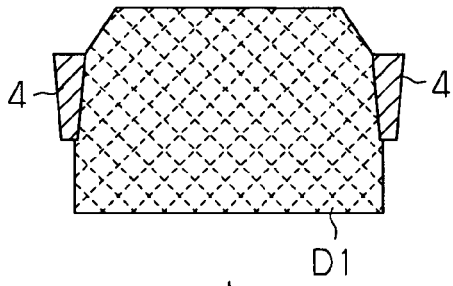
Figure 6C:
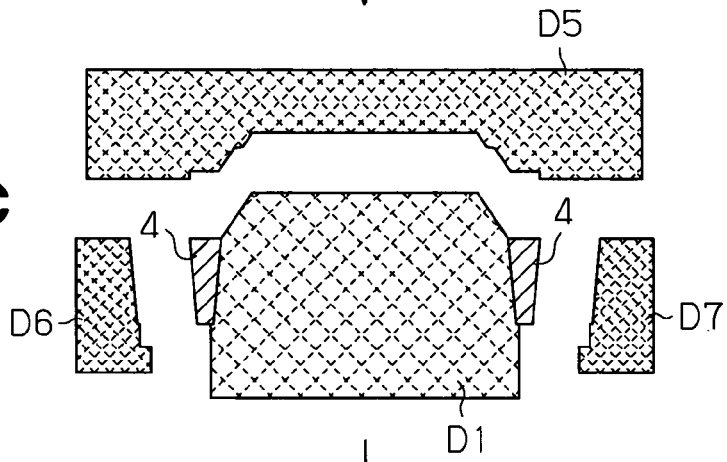
Figure 6D:
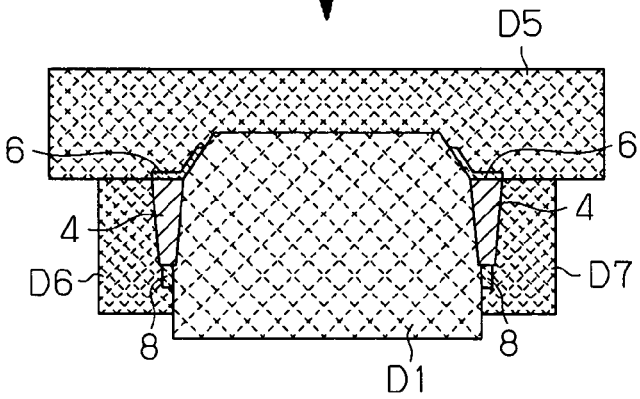

In a second step, referring to FIG. 6B, the dies D2 to D4 are removed from the core die D1. Next, in a third step, as illustrated in FIG. 6C, a cavity die D5 for the lip member 6 and sliding dies D6, D7 for the contact member 8 are combined with the core D1 including the completed base member 4. In a fourth step, referring to FIG. 6D, material is injected into the space for forming the lip member 6 and the contact member 8, which is provided by combining the core die D1, the cavity die D5, and the sliding dies D6, D7. In this manner, the lip member 6 and the contact member 8 are provided through injection molding.

As a result, the lip member 6 and the contact member 8 are bonded with the base member 4 in such a manner that the partition member 2 is completed. The seal ring 4*e* is also provided together with the lip member 6 and the contact member 8 through injection molding.

Figure 7:
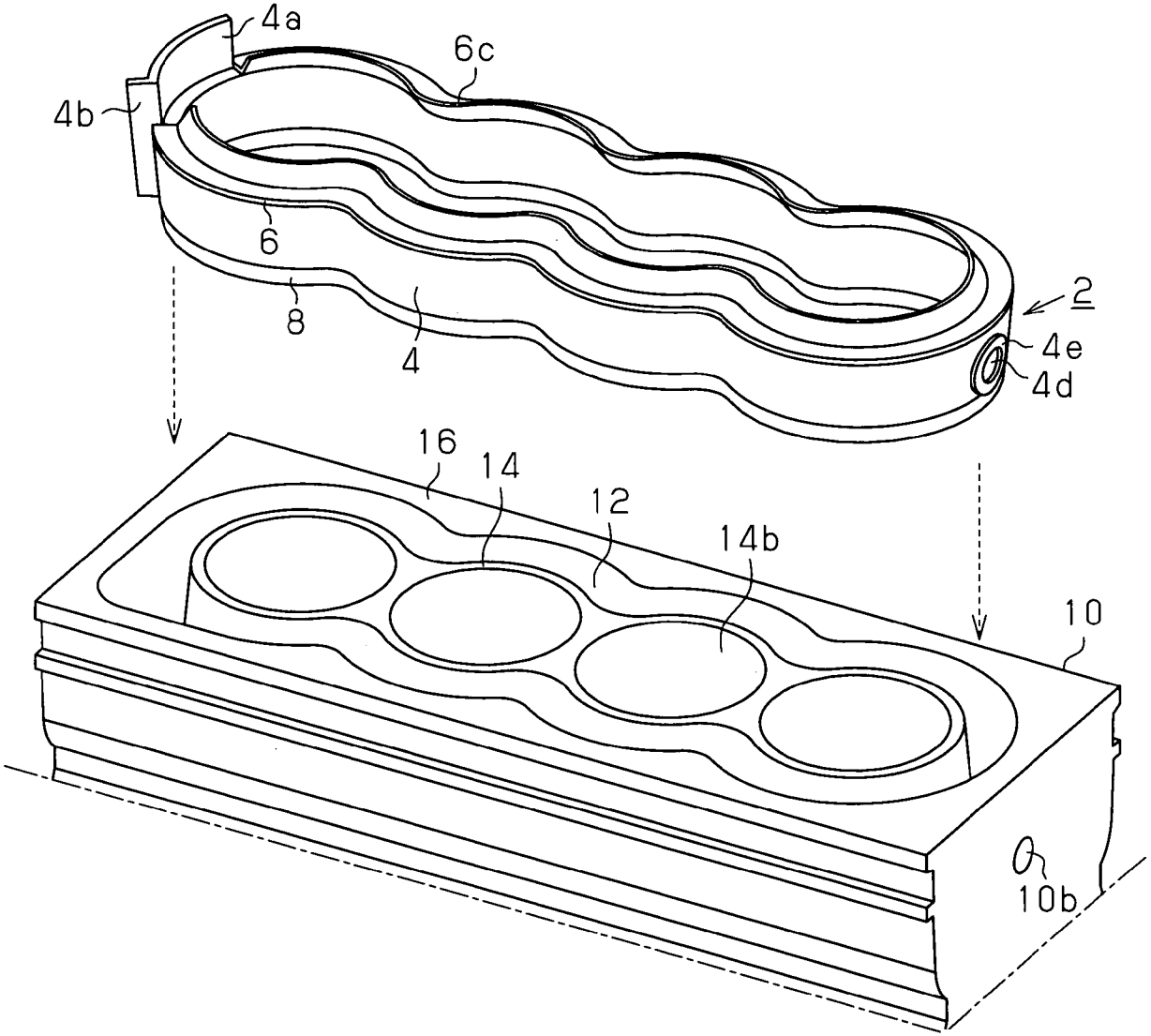
FIG. 7 is a perspective view representing a method for inserting the partition member shown in FIGS. 1A to 1F into the water jacket.
Figure 8C:
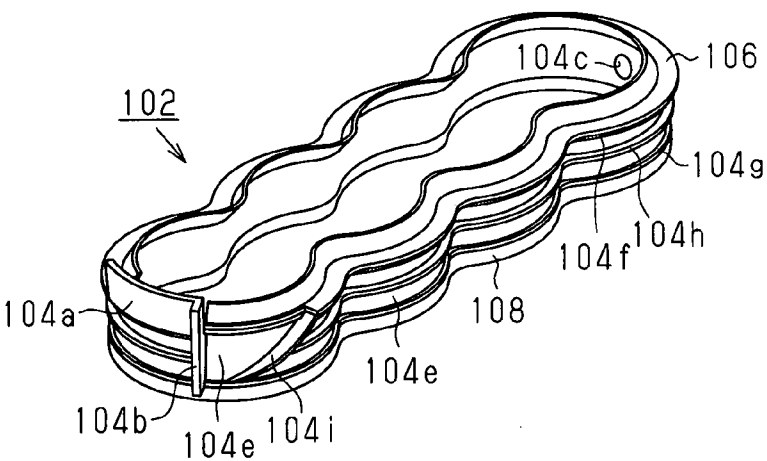
FIGS. 8A, 8B, 8C, 8D, and 8E are views for explaining the configuration of a partition member according to a second embodiment of the present invention.
Figure 8A:
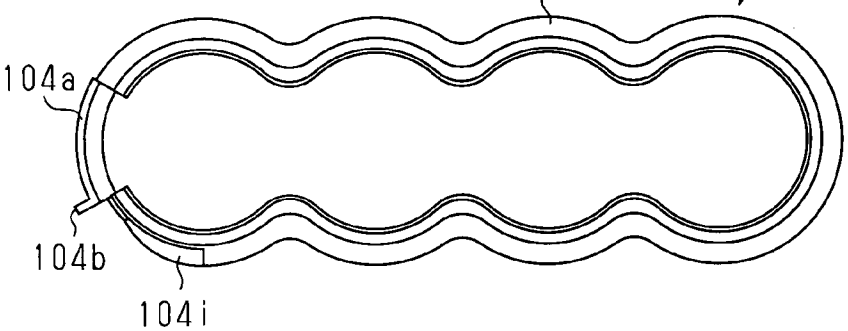
Figure 8E:
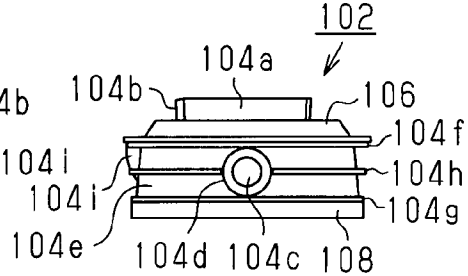
Figure 8D:
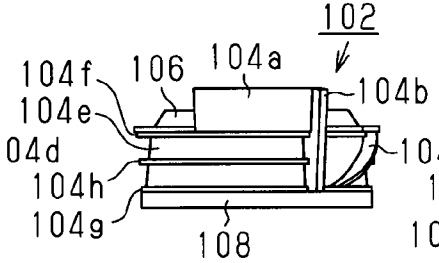
Figure 8B:
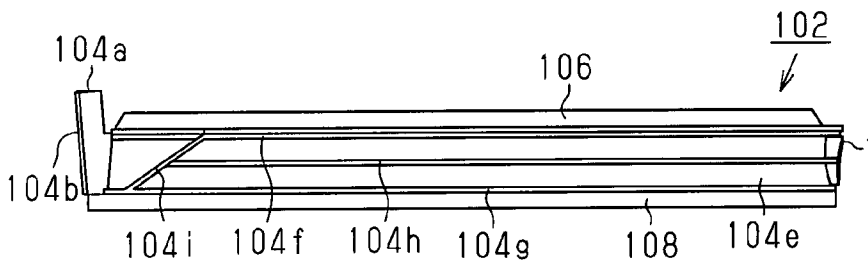

Then, as illustrated in FIG. 7, the obtained partition member 2 is inserted into the water jacket 12 of the cylinder block 10 through an opening defined in the deck surface so that the contact portion 8, which is formed at the lower end of the base member 4, contacts the bottom surface 12*d* of the water jacket 12. A cylinder head is then secured to the cylinder block 10. This causes the upper end of the guide wall 4*a* to contact the cylinder head (or a gasket) so that the partition member 2 becomes fixed in the water jacket 12.

In operation of the engine, coolant is sent from a cooling water pump into the water jacket 12 through the first opening

10*a* (FIG. 3) and then flows through the outer passage 12*b*. Since the cross-sectional area of the outer passage 12*b* is relatively great in the upper area 12*c*, the coolant flows mainly in the upper area 12*c*. The blocking wall 4*b* causes the coolant to flow in a counterclockwise direction in the cylinder block 10 as viewed from above. The coolant then reaches the guide wall 4*a*. Afterwards, the coolant is sent into the water jacket provided in the cylinder head by the guide wall 4*a* and the blocking wall 4*b*.

In operation of the engine, a relatively great amount of coolant flows in the upper area 12*c* in the outer passage 12*b*. The coolant enters the inner passage 12*a* from the outer passage 12*b* only through the spaces defined in the vicinities of the opposite ends of the lip member 8. That is, the coolant is substantially prevented from flowing in the inner passage 12*a*. The cooling efficiency in the upper area 12*c* thus becomes higher than the cooling efficiency in the inner passage 12*a*. This decreases the difference in the temperature in the up-and-down direction of each cylinder bore 14*b*.

Before the engine is started cold, high-temperature coolant, or heated water (pre-heating heat medium), which is retained in a heat accumulating portion, is introduced, in advance, into the inner passage 12*a* from the second opening 10*b* through the seal ring 4*e* and the through hole 4*d*. In this manner, the engine is pre-heated. In such pre-heating, the heated water flowing in the inner passage 12*a* heats a lower portion of the cylinder bore forming body 14 to cause efficient heat transmission. Accordingly, the cylinder bores 14*b* are heated quickly and uniformly.

The first embodiment has the following advantages.

(1) To maintain the shape of the partition member 2 as a whole, the base member 4 is formed of the material with higher rigidity than the rigidity of the lip member 6. However, the above-described shape of the base member 4 facilitates installation of the partition member 2 in the water jacket 12. Since the width of the contact member 8 is smaller than the width of a lower end surface 4*f* of the base member 4, the contact member 8 is easily arranged in the water jacket 12.

Since the lip member 6 is flexible, the lip member 6 does not receive great resistance force from the outer circumferential surface 14*a* of the cylinder bore forming body 14 when the partition member 2 is inserted into the water jacket 12. Thus, the partition member 2 is inserted into the water jacket 12 only with small sliding resistance force. Further, in insertion of the partition member 2 into the water jacket 12, the lip member 6 functions to guide the partition member 2 as a whole to an optimal position in the water jacket 12. Also, after the partition member 2 is received in the water jacket 12, the lip member 6 prevents the partition member 2 from easily separating from the water jacket 12.

Accordingly, an engine cooling mechanism is easily formed through insertion of the partition member 2 into the water jacket 12 through the opening in the deck surface in such a manner that the contact member 8 contacts the bottom surface 12*d* of the water jacket 12. As a result, the partition member 2 is efficiently arranged in the water jacket 12.

(2) After the partition member 2 is inserted into the water jacket 12, the force of the flexible shape restoration of the lip member 6 causes the lip member 6 to maintain contact between the distal edge portion 6*c* and the outer circumferential surface 14*a* of the cylinder bore forming body 14. Since the contact member 8 is arranged at the lower end surface 4*f* of the base member 4, the partition member 2 and the water jacket 12 are held in contact with each other with an increased tightness. This sufficiently ensures independent flows of coolant in the inner passage 12*a* and the outer passage 12*b*. Thus, during the operation of the engine, the difference in the temperature in the up-and-down direction in the cylinder bore forming body 14 is decreased through introduction of the coolant into the outer passage 12*b* through the first opening 10*a*. Also, in the pre-heating, the cylinder bores 14*b* are efficiently heated through introduction of the heated water into the inner passage 12*a* through the seal ring 4*e* and the through hole 4*d*. Accordingly, under any circumstance, the temperature is easily controlled with improved accuracy in the up-and-down direction of the cylinder bore forming body 14.

(3) Through the die rotary molding (coinjection molding), the lip member 6 and the contact member 8 formed of elastomer and the base member 4, which exhibits higher rigidity than the rigidity of the lip member 6 and the contact member 8, are formed as an integral body. The partition member 2 is thus easily manufactured.

Next, a partition member 102 according to a second embodiment of the present invention will be explained with reference to FIGS. 8A to 10. As illustrated in FIGS. 8A to 8E, the partition member 102 of the second embodiment is different from the partition member 2 of the first embodiment. However, a lip member 106 and a contact member 108 of the second embodiment are identical with the lip member 6 and the contact member 108 of the first embodiment. Also, a cylinder block 110 of the second embodiment is identical with the cylinder block 10 of the first embodiment.

Like the base member 4 of the first embodiment, the base member 104 has a guide wall 104*a* and a blocking wall 104*b*, which are provided at positions in an continuous wall 104*e* corresponding to a first cylinder bore #1. The base member 104 also has a through hole 104*c* and a seal ring 104*d*, which are provided at positions corresponding to a fourth cylinder bore #4. An upper frame 104*f*, a lower frame 104*g*, and an intermediate frame 104*h* are provided in the continuous wall 104*e* of the base member 104.

The upper frame 104*f*, the lower frame 104*g*, and the intermediate frame 104*h* each function as a rib that reinforces the continuous wall 104*e*. A lip member 106 is bonded with the top surface of the upper frame 104*f*. A contact member 108 is bonded with the lower surface of the lower frame 104*g*. In other words, the upper frame 104*f* and the lower frame 104*g* integrate the lip member 106 and the contact member 108, respectively, with the base member 104. The thicknesses of the upper frame 104*f*, the lower frame 104*g*, and the intermediate frame 104*h* become gradually smaller in a radially outward direction of the continuous wall 104*e*. Such decreased thicknesses of the frames 104*f*, 104*g*, and 104*h* provide a draft necessary for removing sliding dies D13, D14 from a core die D11. Alternatively, the thickness of the contact member 108 may become gradually smaller from the continuous wall 104*e* toward a bottom surface 112*d* of the water jacket 112.

The continuous wall 104*e* has a guide slope 104*i*, which is arranged adjacent to the blocking wall 104*b*. If coolant is introduced between the blocking wall 104*b* and the inclined surface of the guide slope 104*i* with the partition member 102 received in the water jacket 112, the blocking wall 104*b* causes the coolant to flow in a counterclockwise direction as viewed from above, as in the first embodiment. In this state, the guide slope 104*i* smoothly guides the coolant to an upper area 112*c* in the water jacket 112, which is a portion of an outer passage 112*b*.

The partition member 102 is formed by a method similar to the method for forming the partition member 2 of the first embodiment. That is, the lip member 106 and the contact member 108 may be bonded with the base member 104 using adhesive or through welding or mechanical engagement. Alternatively, such bonding may be brought about through the die rotary molding, as illustrated in FIG. 10. The procedure of the die rotary molding of the second embodiment is similar to the corresponding procedure of the first embodiment.

Figure 10A:
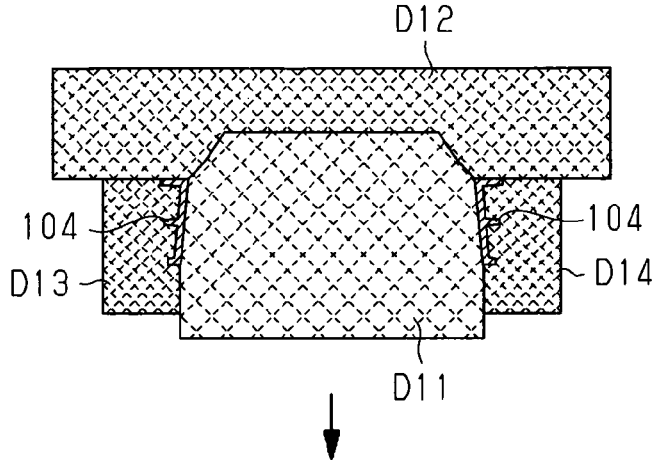
FIGS. 10A, 10B, 10C, and 10D are views for explaining a method for molding the partition member of FIGS. 8 to 8E.
Figure 10B:
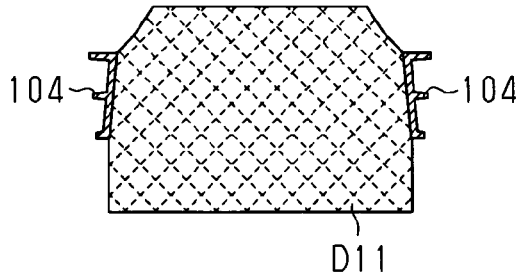
Figure 10C:
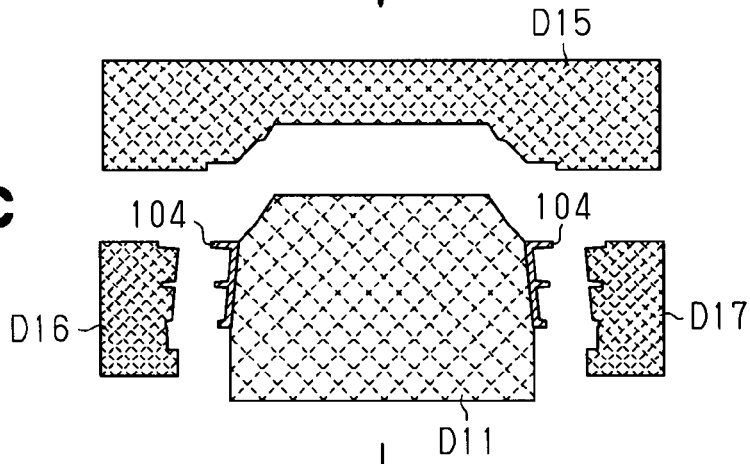
Figure 10D:
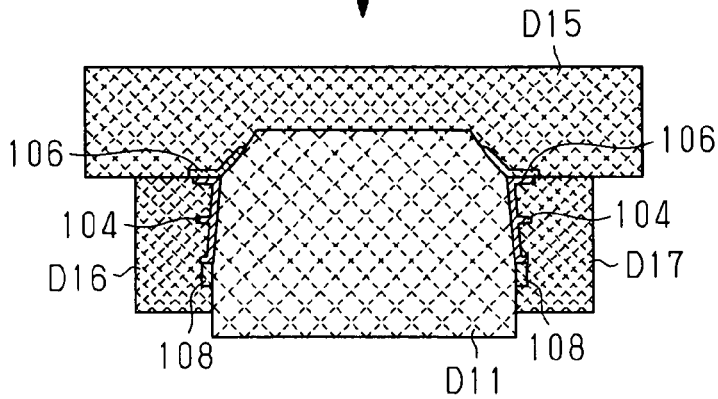

As illustrated in FIG. 10A, in a first step, the base member 104 is formed through injection molding using the core die D11, a cavity die D12, and the sliding dies D13, D14. In a second step, referring to FIG. 10B, the dies D12 to D14 are removed from the core die D11. Next, in a third step, as illustrated in FIG. 10C, a cavity die D15 for the lip member 106 and sliding dies D16, D17 for the contact member 108 are combined with the core die D11 having the completed base member 104. In a fourth step, referring to FIG. 10D, material is injected into the space for forming the lip member 106 and the contact member 108, which is provided by the core die D11, the cavity die D15, and the sliding dies D16, D17 that are combined together. In this manner, the lip member 106 and the contact member 108 are formed through injection molding. As a result, the lip member 106 and the contact member 108 are bonded with the base member 104 and the partition member 102 is completed.

Figure 9:
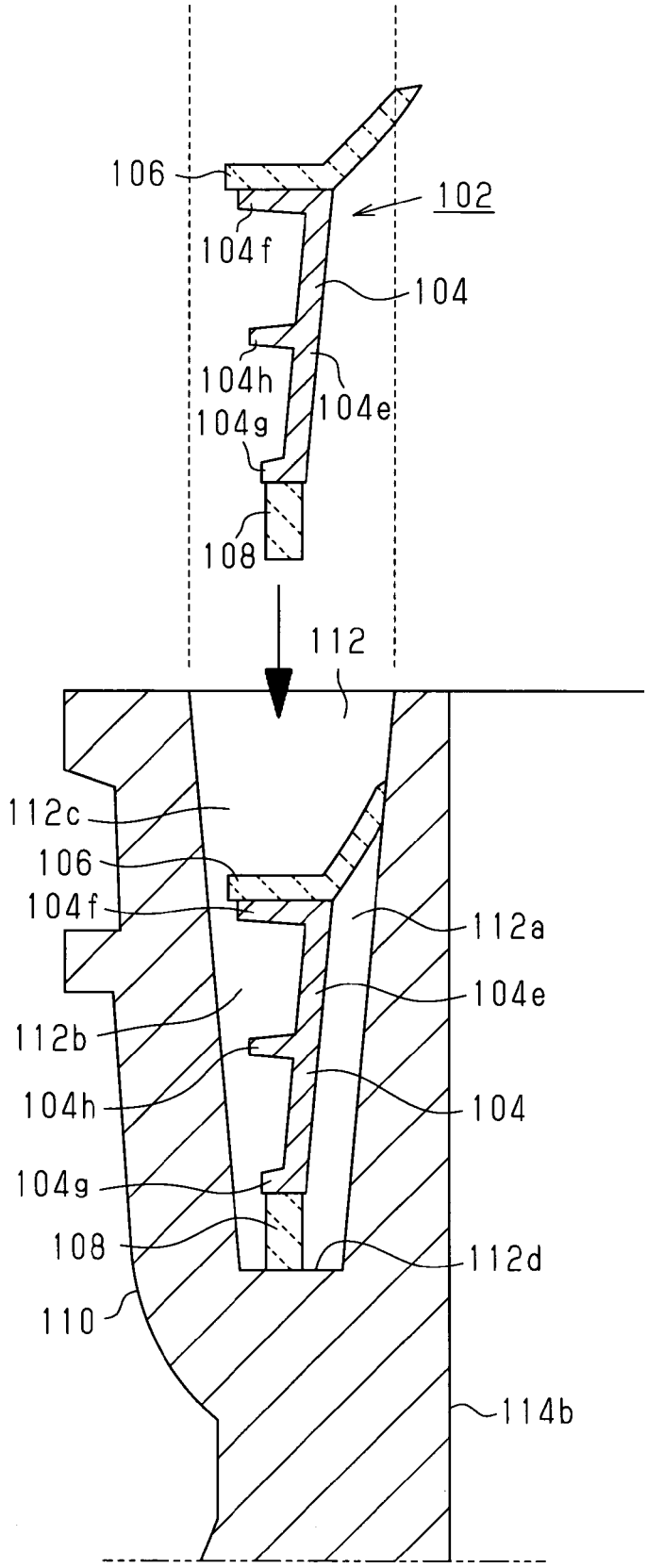
FIG. 9 is a longitudinal cross-sectional view showing the position of the partition member shown in FIGS. 8A to 8E in relation to the position of the water jacket.

The thus formed partition member 102 is inserted into the water jacket 112 in the cylinder block 110, as illustrated in FIG. 9. Afterwards, a cylinder head is secured to the cylinder block 110 in such a manner that the upper end of the guide wall 104*a* contacts the cylinder head (or a gasket). This fixes the partition member 102 in the water jacket 112.

The second embodiment has the following advantages.

(1) In addition to the advantages of the first embodiment, since the thickness of the base member 104 is reduced, the weight of the engine is prevented from being increased. Further, since the guide slope 104*i* smoothly guides the coolant, the difference in the temperature in an up-and-down direction of each cylinder bore 114*b* is easily decreased.

(2) The upper frame 104*f*, the lower frame 104*g*, and the intermediate frame 104*h* each function as a rib reinforcing the continuous wall 104*e*. Thus, regardless of the decreased thickness of the base member 104, the partition member 102 maintains sufficiently high strength.

The present invention is not restricted to the above illustrated embodiments but may be embodied in the following forms.

Figure 11:
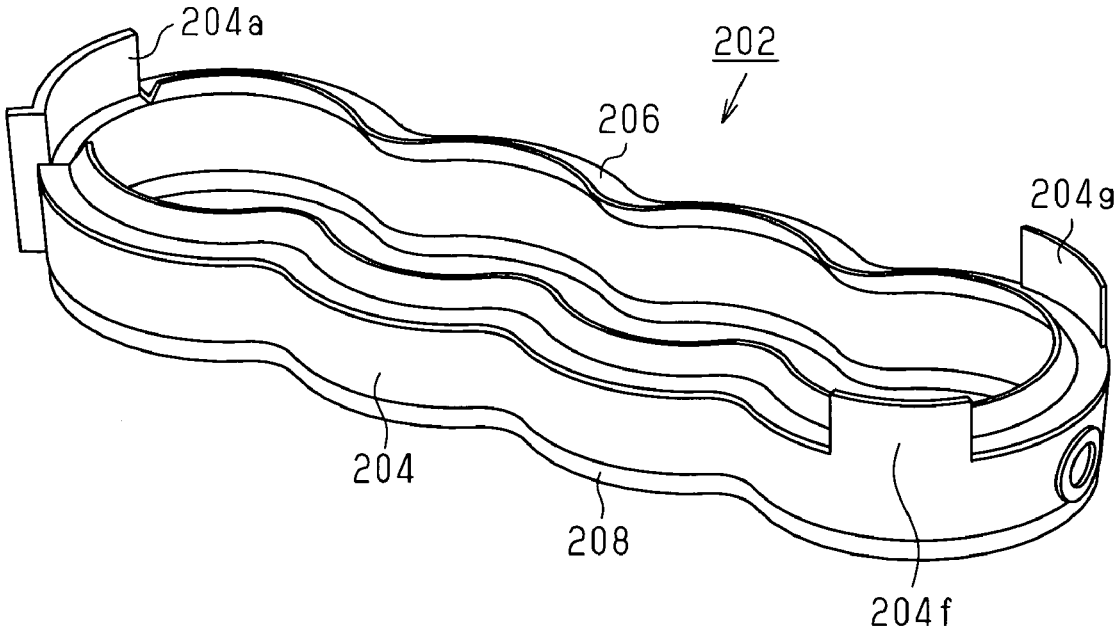
FIG. 11 is a perspective view showing a partition member according to another embodiment of the present invention.

In the first embodiment, the guide wall 4*a* guides the coolant and reliably fixes the partition member 2 as a whole to the cylinder block 10. To further securely fix the partition member 2 to the cylinder block 10, as illustrated in FIG. 11, projections 204*f*, 204*g* each having a height equal to the height of the guide wall 204*a* may be provided in addition to the guide wall 204*a*, which is formed in the portion of the base member 204 corresponding to the first cylinder bore #1. The projections 204*f*, 204*g* project from portions of the base member 204 corresponding to a fourth cylinder bore #4. This reliably fixes the partition member 202 at the side corresponding to the fourth cylinder bore. #4. Such structure may be employed also in the partition member 102 of the second embodiment.

FIGS. 12A to 13B illustrate partition members according to other embodiments of the present invention. A partition member 302 shown in FIG. 12A does not include a member corresponding to the contact member 8 of the partition member 2 of the first embodiment. Specifically, a base member 304 formed of olefin-based resin directly contacts a bottom surface 312*d* of a water jacket 312 in a cylinder block 310. Since the base member 304 has rigidity higher than the rigidity of the lip member 306, tightness of contact between the partition member 303 and the bottom surface 312*d* is slightly decreased. However, independent flows of coolant in an inner passage 312*a* and an outer passage 312*b* are sufficiently maintained. Thus, the partition member 302 has the advantages equivalent to the advantages of the partition member 2 of the first embodiment. Also, since the partition member 302 does not employ the contact member 8 formed of elastomer, the material cost and the manufacturing cost are saved.

Figure 12A:
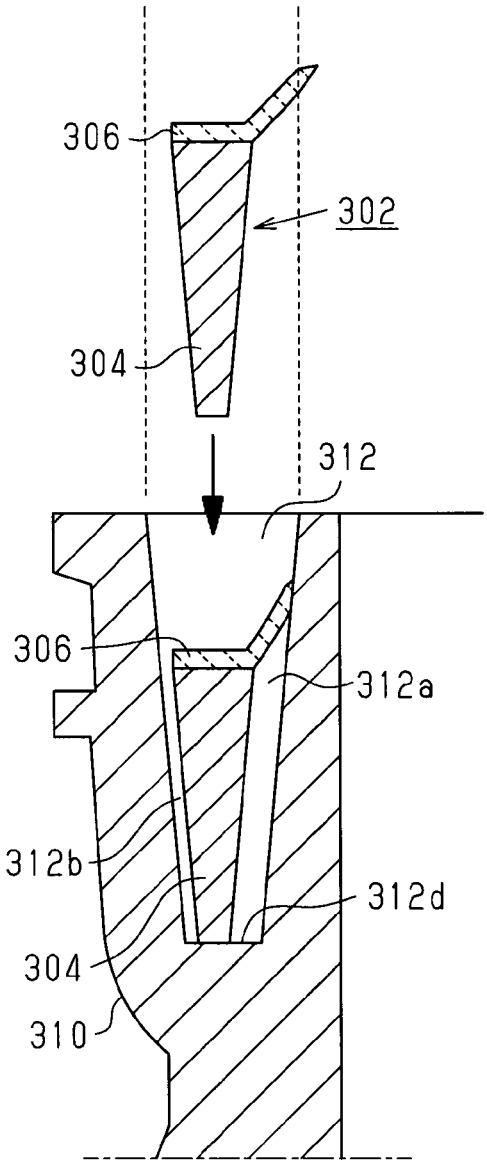
FIGS. 12A and 12B are longitudinal cross-sectional views each showing the position of a partition member according to another embodiment of the present invention in relation to the position of a water jacket.
Figure 12B:
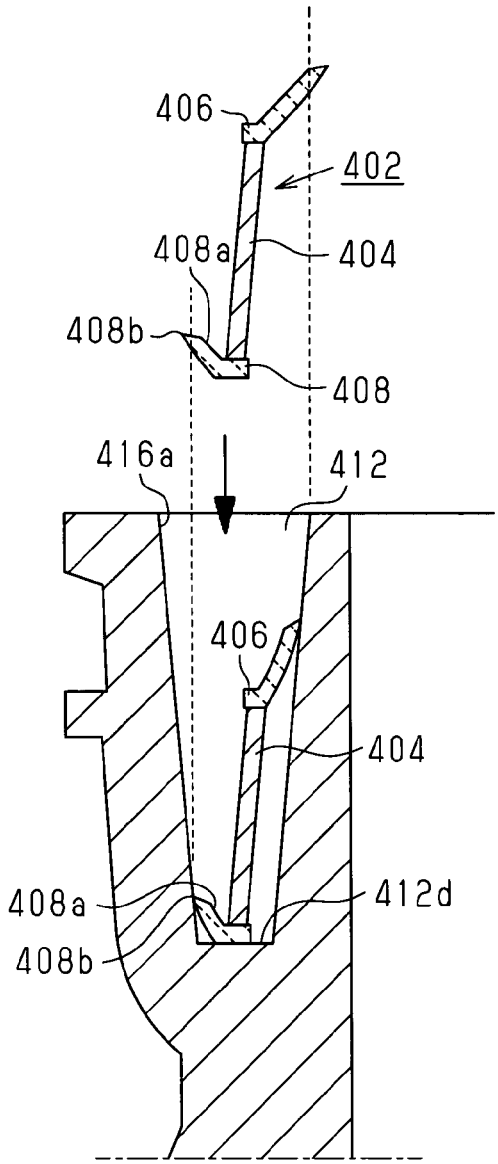

A partition member 402 illustrated in FIG. 12B includes a contact member 408 shaped identically with a lip member 406. Specifically, the contact member 408 includes a lip portion 408*a* and a distal edge portion 408*b*. The lip portion 408*a* projects toward an opening defined in a water jacket 412. The distal edge portion 408*b* is provided at a distal end of the lip portion 408*a* and contacts an inner surface 416*a* of the water jacket 412. In other words, when the partition member 402 is not received in the water jacket 412, the distal edge portion 408*b* is located outward from the inner surface 416*a* of the water jacket 412.

Accordingly, even if the bottom surface 412*d* of the water jacket 412 is formed with significantly low flatness, contact between the lip portion 408*a* and the inner surface 416*a* improves the tightness of contact between the partition member 402 and the water jacket 412 in a lower portion of the partition member 402. Thus, the partition member 402 has the advantages equivalent to the advantages of the partition member 2 of the first embodiment. Further, since the base member 404 of the partition member 402 has decreased thickness, the weight of the engine is decreased.

Figure 13A:
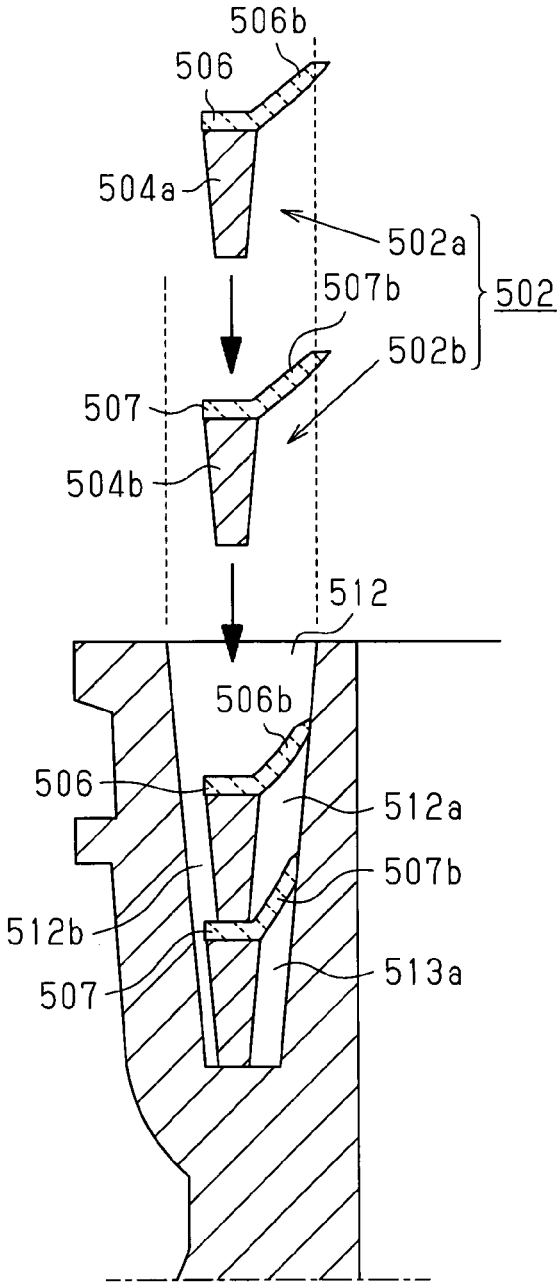
FIGS. 13A and 13B are longitudinal cross-sectional views each showing the position of a partition member according to another embodiment of the present invention in relation to the position of a water jacket.

A partition member 502 shown in FIG. 13A is provided by stacking two partition members 502*a*, 502*b* in an up-and-down direction in a water jacket 512. The partition member 502*a* has a base member 504*a* and a lip member 506, which is formed integrally with the base member 504*a*. The partition member 502*b* has a base member 504*b* and a lip member 507, which is formed integrally with the base member 504*b*. The base member 504*a* and the base member 504*b* are each configured identically with the partition member 302 shown in FIG. 12A. However, the height of each base member 504*a*, 504*b* is approximately the half the height of the partition member 302. Each of the lip members 506, 507 is formed of flexible material as in the above-illustrated embodiments. Through stacking of the partition members 502*a*, 502*b* in the up-and-down direction, the partition member 502 defines an inner passage 512*a* and an inner passage 513*a*, which are separate from each other, and an outer passage 512*b*, which is separate from the inner passages 512*a*, 513*a*. Heater water may be introduced into one or both of the inner passages 512*a*, 513*a*. The partition member 502 has the advantages equivalent to the advantages of the partition member 2 of the first embodiment. Further, since the base members 504*a*, 504*b* are formed as an integral body, the inner passage 512*a* between the lip members 506, 507 is sealed with improved tightness.

The height of the base member 504*a* and the height of the base member 504*b* may differ from each other. In correspondence with the difference between the height of the base member 504*a* and the height of the base member 504*b*, the ratio of the cross-sectional area of the inner passage 513*a* with respect to the cross-sectional area of the inner passage 512*a* is adjusted.

Figure 13B:
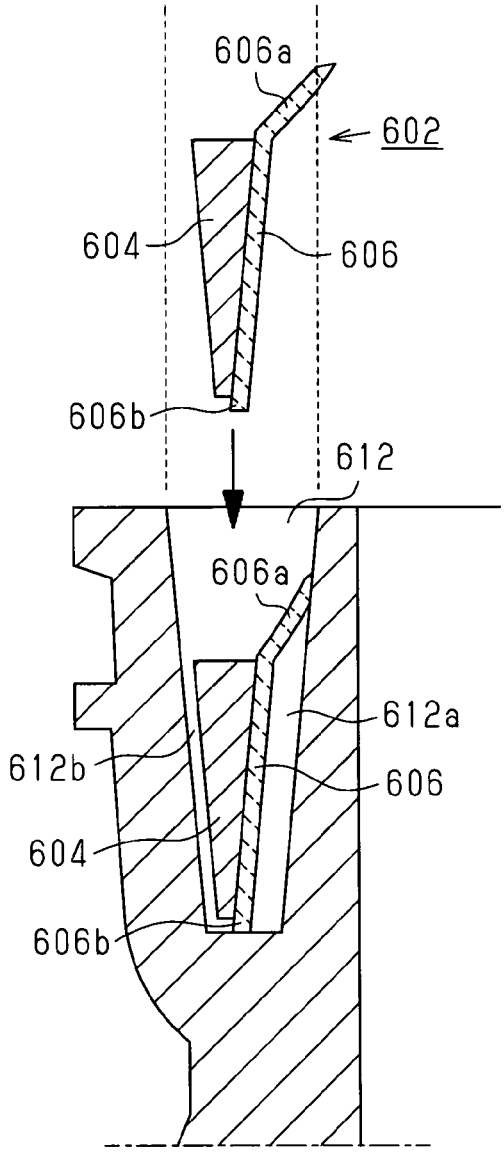

A partition member 602 illustrated in FIG. 13B has a flexible member 606 provided by forming a lip member 606*a* and a contact member 606*b* as an integral body. In other words, the flexible member 606 is formed integrally with a side surface of a base member 604 in such a manner as to extend beyond the base member 604 in an up-and-down direction. As a result, the partition member 602 has the advantages equivalent to the advantages of the partition member 2 of the first embodiment.

Figure 14:
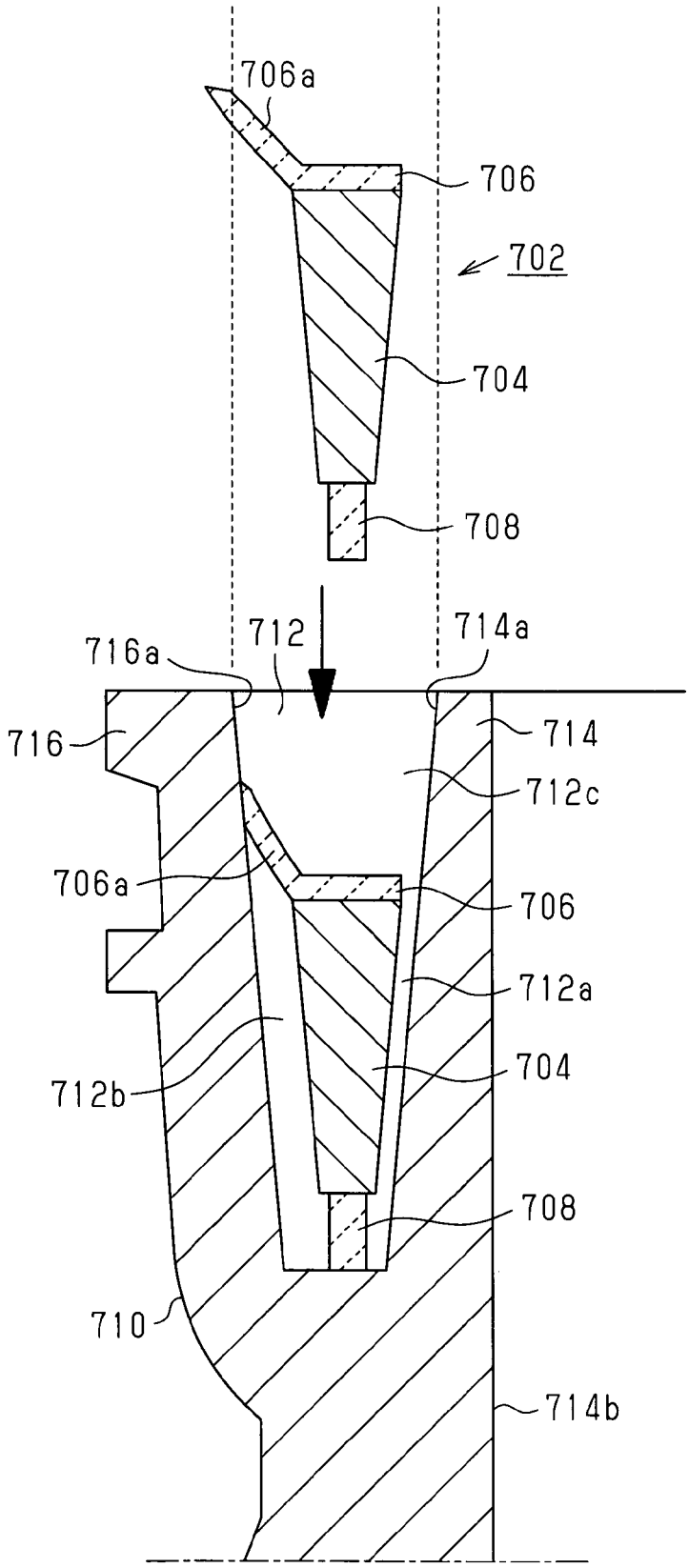
FIG. 14 is a longitudinal cross-sectional view showing the position of a partition member according to another embodiment of the present invention in relation to the position of a water jacket.

In each of the illustrated embodiments, a lip portion of a lip member contacts an outer circumferential surface of a cylinder bore forming body. However, if heated water for preheating is not used, a lip portion 706*a* of a lip member 706 may contact an inner circumferential surface 716*a* of an outer circumferential wall 716 of a cylinder block 710 as illustrated in FIG. 14.

This maintains an inner passage 712*a* and an outer passage 712*b*, which are defined by the base member 704, in a mutually separate state. Thus, independent flows of coolant in the inner passage 712*a* and the outer passage 712*b* are ensured. This facilitates the formation of a cooling mechanism of an engine, and the temperature control with an improved accuracy is easily performed on cylinder bores 714*b*. That is, the flow of the coolant in an upper portion of a cylinder bore forming body 714 becomes greater than the flow of the coolant in a lower portion of the cylinder bore forming body 714. Further, the partition member 702 makes it difficult for the lower portion of the cylinder bore forming body 714 to release heat to the exterior, thus decreasing the difference in the temperature in an up-and-down direction of each cylinder bore 714*b*.

The invention claimed is:

1. A partition member provided in a cylinder block of an internal combustion engine, the engine having a groove-like cooling passage through which a cooling heat medium flows, the partition member being arranged in the groove-like cooling passage, wherein the cooling passage extends to encompass cylinder bores of the cylinder block, wherein the cooling passage has a bottom surface, a pair of opposing inner surfaces, and an opening located opposite to the bottom surface, the partition member comprising:

a separating wall that divides the cooling passage into an inner passage and an outer passage, the inner passage being located close to the cylinder bores, the outer passage being located outside of the inner passage, wherein the separating wall has a lower end portion facing the bottom surface of the cooling passage and an upper end portion located opposite to the lower end portion, wherein, when the partition member is arranged in the cooling passage, the height from the bottom surface of the cooling passage to the upper end portion of the separating wall is less than the depth of the cooling passage so that the cooling passage includes an upper area existing above the upper end portion of the separating wall and extending over the entire width between the opposing inner surfaces; and a flexible lip member that extends from the upper end portion of the separating wall toward the opening in such a manner that, when the partition member is arranged in the cooling passage, the lip member contacts one of the inner surfaces at an intermediate position in a direction along the depth of the cooling passage so that the upper area constitutes a portion of one of the inner and outer passages and is separated from the other one of the inner and outer passages, wherein the lip member has a distal edge portion that extends beyond the one inner surface before the partition member is arranged in the cooling passage, and wherein, when the partition member is arranged in the cooling passage, the distal edge portion contacts the one inner surface due to force produced through flexible shape restoration of the lip member.

2. The partition member according to claim 1, wherein the lip member is formed of an elastomer, and wherein the separating wall is formed of a material having a rigidity higher than that of the lip member.

3. The partition member according to claim 2, wherein the lip member is formed of an olefin-based elastomer, and wherein the separating wall is formed of an olefin-based resin.

4. The partition member according to claim 1, wherein the lip member extends from the upper end portion of the separating wall in such a manner as to contact the inner surface closer to the cylinder bores, and wherein the lower end portion of the separating wall includes a contact portion that contacts the bottom surface of the cooling passage.

5. The partition member according to claim 4, wherein the contact portion is formed of a flexible material.

6. The partition member according to claim 4, wherein the separating wall, the lip member, and the contact portion are formed as an integral body through die rotary molding.

7. A cooling mechanism of an internal combustion engine, comprising:

a groove-like cooling passage provided in a cylinder block of the engine, wherein a cooling heat medium flows through the cooling passage, wherein the cooling passage extends to encompass cylinder bores of the cylinder block, and wherein the cooling passage has a bottom surface, a pair of opposing inner surfaces, and an opening located opposite to the bottom surface; and a partition member arranged in the cooling passage, the partition member having a separating wall and a flexible lip member, wherein the separating wall divides the cooling passage into an inner passage and an outer passage, the inner passage being located close to the cylinder bores, the outer passage being located outside of the inner passage, wherein the separating wall has a lower end portion facing the bottom surface of the cooling passage and an upper end portion located opposite to the lower end portion, wherein a contact portion that contacts the bottom surface of the cooling passage is provided on the lower end portion, and wherein, when the partition member is arranged in the cooling passage, the height from the bottom surface of the cooling passage to the upper end portion of the separating wall is less than the depth of the cooling passage, and wherein the flexible lip member extends from the upper end portion of the separating wall toward the opening in such a manner that, when the partition member is arranged in the cooling passage, the lip member contacts the inner surface closer to the cylinder bores at an intermediate position in a direction along the depth of the cooling passage, wherein the lip member has a distal edge portion that extends beyond the inner surface closer to the cylinder bores before the partition member is arranged in the cooling passage, and wherein, when the partition member is arranged in the cooling passage, the distal edge portion contacts the inner surface closer to the cylinder bores due to force produced through flexible shape restoration of the lip member, and wherein the cylinder block has a first supply port for supplying cooling heat medium to the cooling passage, the first supply port being opened to the outer passage.

8. The cooling mechanism according to claim 7, wherein the cylinder block has a second supply port for supplying cooling heat medium for pre-heating the engine to the cooling passage, the second supply port being opened to the inner passage.

9. A method for forming a cooling mechanism of an internal combustion engine, comprising:

providing a groove-like cooling passage through which a cooling heat medium flows in a cylinder block of the engine, wherein the cooling passage extends to encompass cylinder bores of the cylinder block, and wherein the cooling passage has a bottom surface, a pair of opposing inner surfaces, and an opening located opposite to the bottom surface;

preparing a partition member that is arranged in the cooling passage, the partition member having a separating wall and a flexible lip member, wherein the separating wall divides the cooling passage into an inner passage and an outer passage, the inner passage being located close to the cylinder bores, the outer passage being located outside of the inner passage, wherein the separating wall has a lower end portion facing the bottom surface of the cooling passage and an upper end portion located opposite to the lower end portion, wherein a contact portion that contacts the bottom surface of the cooling passage is provided on the lower end portion, and wherein, when the partition member is arranged in the cooling passage, the height from the bottom surface of the cooling passage to the upper end portion of the separating wall is less than the depth of the cooling passage so that the cooling passage includes an upper area existing above the upper end portion of the separating wall and extending over the entire width between the opposing inner surfaces, wherein the lip member extends from the upper end portion of the separating wall toward the opening in such a manner that, when the partition member is arranged in the cooling passage, the lip member contacts the inner surface closer to the cylinder bores at an intermediate position in a direction along the depth of the cooling passage so that the upper area constitutes a portion of one of the inner and outer passages and is separated from the other one of the inner and outer passages, wherein the lip member has a distal edge portion that extends beyond the inner surface closer to the cylinder bores before the partition member is arranged in the cooling passage; and inserting the partition member through the opening of the cooling passage until the contact portion contacts the bottom surface of the cooling passage, wherein, when the partition member is arranged in the cooling passage, the distal edge portion contacts the inner surface closer to the cylinder bores due to force produced through flexible shape restoration of the lip member.

* * * * *